US009541345B2

(12) United States Patent
Schwartzkopf

(10) Patent No.: US 9,541,345 B2
(45) Date of Patent: Jan. 10, 2017

(54) RECOIL AND MUZZLE BLAST CONTROLLER FOR FIREARMS

(71) Applicant: Steven H. Schwartzkopf, Saratoga, CA (US)

(72) Inventor: Steven H. Schwartzkopf, Saratoga, CA (US)

( * ) Notice: Subject to any disclaimer, the term of this patent is extended or adjusted under 35 U.S.C. 154(b) by 140 days.

(21) Appl. No.: 14/662,196

(22) Filed: Mar. 18, 2015

(65) Prior Publication Data

US 2016/0273862 A1 Sep. 22, 2016

Related U.S. Application Data

(60) Provisional application No. 61/955,021, filed on Mar. 18, 2014.

(51) Int. Cl.
*F41A 21/00* (2006.01)
*F41A 21/38* (2006.01)

(52) U.S. Cl.
CPC ..... *F41A 21/38* (2013.01)

(58) Field of Classification Search
CPC ..... F41A 21/38
USPC ..... 89/14.2–14.4
See application file for complete search history.

(56) References Cited

U.S. PATENT DOCUMENTS 1,773,443 A 8/1930 Wilman
1,901,138 A * 3/1933 Barnes ..... F41A 21/36 89/14.3
2,065,273 A 12/1936 Galliot
2,143,596 A 1/1939 Galliot
2,514,996 A 7/1950 Faust, Jr.
2,899,866 A * 8/1959 Clark ..... F41A 21/32 89/127
3,748,956 A 7/1973 Hubner
3,786,895 A 1/1974 Perrine
4,307,652 A 12/1981 Witt
4,576,083 A 3/1986 Seberger, Jr.
4,638,713 A 1/1987 Milne
4,907,488 A 3/1990 Seberger
5,136,923 A 8/1992 Walsh, Jr.
5,675,107 A 10/1997 Ledys
5,726,375 A 3/1998 Adams
6,298,764 B1 10/2001 Sherman
6,308,609 B1 10/2001 Davies
6,575,266 B1 6/2003 Gehse
6,899,008 B2 5/2005 Breuer
6,923,292 B2 8/2005 Woods
7,073,426 B1 * 7/2006 White ..... F41A 21/30 181/223
7,353,741 B2 4/2008 Brixius
7,516,690 B2 4/2009 McClellan
7,789,008 B2 9/2010 Petersen
7,832,323 B1 * 11/2010 Davies ..... F41A 21/30 89/14.4

(Continued)

*Primary Examiner* — Samir Abdosh
(74) *Attorney, Agent, or Firm* — Yancy IP Law, PLLC

(57) ABSTRACT

A recoil and blast controller (RBC), which may also be referred to as a muzzle brake, is attached to the muzzle of a firearm providing a mechanism for the specific purposes of controlling and reducing the intensity of the recoil, the muzzle rise, and the muzzle blast that occur when the firearm is discharged. The RBC includes: at least one internally-vented buffer chamber provided in at least one tubular buffer chamber housing; and a tubular depressurization chamber that is externally-vented.

20 Claims, 1 Drawing Sheet

(56) References Cited

U.S. PATENT DOCUMENTS

| | | | | |
|---|---|---|---|---|
| 8,196,701 | B1 | 6/2012 | Oliver | |
| 8,397,862 | B2 | 3/2013 | Shand | |
| 8,464,625 | B2 | 6/2013 | Polovnev | |
| 8,695,474 | B2 * | 4/2014 | Overbeek Bloem | F41A 21/325 89/14.2 |
| 8,695,475 | B2 | 4/2014 | Schneider | |
| 8,991,552 | B2 * | 3/2015 | Latka | F41A 21/30 181/223 |
| 2008/0148928 | A1 | 6/2008 | McClellan | |
| 2010/0180759 | A1 * | 7/2010 | Petersen | F41A 21/30 89/14.4 |
| 2015/0040448 | A1 * | 2/2015 | Overbeek Bloem | F41A 21/325 42/1.06 |

* cited by examiner

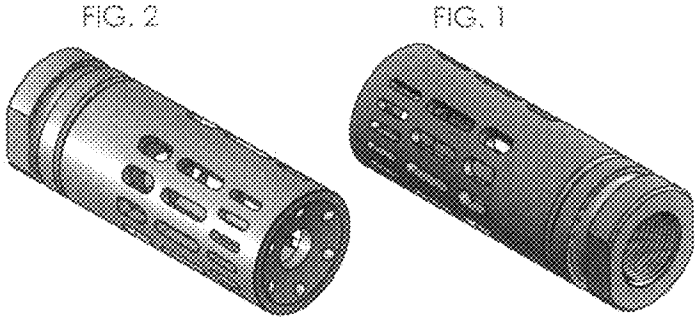
FIG. 1
FIG. 2
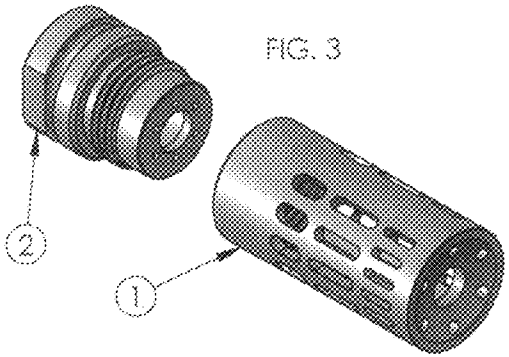
FIG. 3
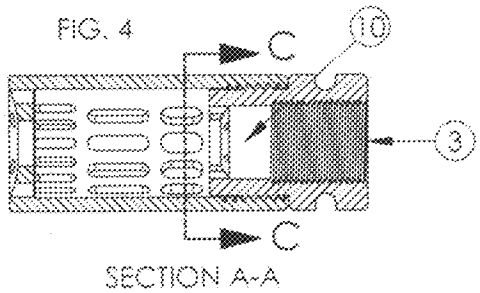
FIG. 4
SECTION A-A
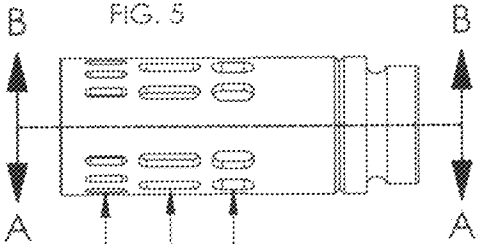
FIG. 5
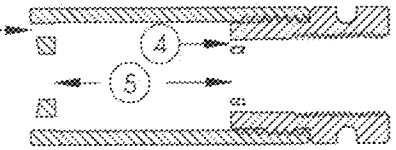
FIG. 6
SECTION B-B
CUT FACES ONLY
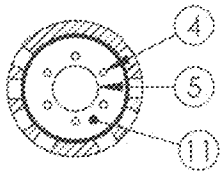
FIG. 7
SECTION C-C
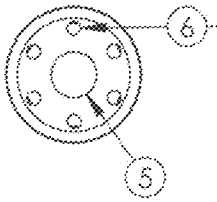
FIG. 8

RECOIL AND MUZZLE BLAST CONTROLLER FOR FIREARMS

CROSS-REFERENCE TO RELATED APPLICATIONS

This application claims the benefit, under 35 U.S.C. 119(e), of U.S. Provisional Application No. 61/955,021 filed Mar. 18, 2014, the contents of which are incorporated herein by reference.

BACKGROUND OF THE INVENTION

1. Field of the Invention

This invention relates generally to a recoil and blast controller (RBC), which may also be referred to as a muzzle brake, for a firearm that reduces the intensity of the recoil, the muzzle rise, and the muzzle blast effects produced by the high-pressure propellant gas as it flows out of the firearm barrel.

2. Description of the Background Art

A recoil and blast reducer functions by redirecting, usually to the side or the rear of the firearm, the flow of high-pressure propellant gas (produced by combustion of the propellant charge) that is emitted from the firearm's barrel in the forward direction after the passage of the bullet, thus reducing both the recoil of the firearm and the effects of the blast that occurs when the gas is released. In prior examples, the flow of the high pressure gas is directed by various structural features of the recoil and blast reducer as the gas emerges from the barrel immediately after the projectile has left the barrel. Typically, in prior examples, the combustion gas is deflected at right angles, or even slightly rearward, by its impingement on the structural features of the recoil and blast reducer. This impingement and deflection has two effects, first transferring a portion of the gas' energy to the firearm's barrel in order to aid in reducing recoil, and second acting to spread out and reduce the blast effect of the gas as it is emitted from the barrel.

The prior art discloses a muzzle brake in which the propellant gas is deflected through directed gas outlet openings onto a large baffle surface and from there to the outside, and is effectively nothing more than two muzzle brakes combined into one new muzzle brake.

Additionally, the prior art discloses a muzzle brake with rearward-deflected baffle surfaces and tubes, which are screwed onto the muzzle. For optimal recoil absorption by the muzzle brake, a portion of the propellant gas is also directed to exit from the muzzle brake in the forward direction.

Also disclosed in the prior art is a muzzle brake in which the gun barrel forms part of the muzzle brake. The muzzle brake region has openings that are covered by a tubular casing with slot-shaped gas outlet openings.

Recoil-absorbing devices for handguns are also known in which high pressure gas is deflected via nozzle openings, and a container filled with coolant is incorporated to cool the deflected gases.

Also disclosed in the prior art is a gun muzzle brake which incorporates a device that can trap the high-pressure gas and divert it toward the front of the firearm. The openings for discharging the gas are arranged so that they force the gas to flow in a direction transverse to the axis of the weapon, so that the gas flow disperses under the effects of centrifugal force.

Furthermore, a signature-reduced muzzle brake is known in which the propellant gas emerging from the barrel is diverted to gas outlet openings of the muzzle brake in order to impinge on them to absorb the recoil and then made to pass further to the rear where it is cooled in a separate device.

SUMMARY OF THE INVENTION

The present invention is directed to a recoil and blast controller (RBC), which may also be referred to as a muzzle brake, for attachment to the muzzle of a firearm that reduces the intensity of the recoil, the muzzle rise, and the muzzle blast effects produced by the high-pressure propellant gas as it flows out of the firearm barrel. Toward this end, the high-pressure propellant gas emerging from the firearm's barrel is generally directed onto gas vents of the muzzle brake in order to impinge thereon to absorb the firearm's recoil and then guided further to the outside in a manner that reduces the muzzle rise and the blast effects of the escaping high-pressure gas.

The RBC, according to an embodiment described herein, primarily includes two component parts: a tubular depressurization chamber and at least one tubular buffer chamber housing. In operation, the RBC is attached to the muzzle of a firearm preferably by screwing a threaded section of a tubular buffer chamber housing onto the threaded section of the muzzle. When the firearm is discharged, the bullet is propelled down the bore of the firearm's barrel and ultimately passes through at least one internally-vented buffer chamber of the RBC, then into the tubular depressurization chamber and out the end of the RBC. During this passage, the high-pressure gas is captured, channeled and directed in a manner that reduces both recoil and blast effects. It should be noted that the manner in which the high-pressure gas is captured, channeled and directed through the use of at least one tubular buffer chamber housing and a tubular depressurization chamber, is novel and unlike any other known RBC or muzzle brake.

BRIEF DESCRIPTION OF THE DRAWINGS

The present invention will be more fully understood from the detailed description given below and the accompanying drawings which are given by way of illustration only, and thus, are not limiting of the present invention:

FIG. 1 shows a model of the assembled RBC from the rear, where it screws onto the barrel of the firearm, in accordance with one embodiment of the present invention, FIG. 2 shows a model of the assembled RBC from the front in accordance with one embodiment of the present invention, FIG. 3 shows a model of one embodiment of an RBC with only two component parts: a tubular depressurization chamber 1 and a tubular buffer chamber housing 2, in accordance with one embodiment of the present invention, FIG. 4 is a cross-sectional lengthwise view through the assembled RBC in accordance with one embodiment of the present invention, FIG. 5 is a top, external view of the assembled RBC in accordance with one embodiment of the present invention.

FIG. 6 is a cross-sectional lengthwise representation B-B from FIG. 5 through the assembled RBC, showing the cut faces only in accordance with one embodiment of the present invention, FIG. 7 is a cross-sectional representation C-C from FIG. 4 showing the interior front face of the tubular buffer chamber housing, and FIG. 8 is an external, end view of the exterior front face of the tubular depressurization chamber from FIG. 5 in accordance with one embodiment of the present invention.

DETAILED DESCRIPTION

The present invention is directed to a recoil and blast controller (RBC), which may also be referred to as a muzzle brake. In accordance with one embodiment of the present invention, FIG. 1 shows a model of the assembled RBC from the rear, where it preferably screws onto the barrel of the firearm, and FIG. 2 shows a model of the assembled RBC from the front. As illustrated in FIG. 3, the RBC in accordance with one embodiment of the present invention primarily includes two components: a tubular depressurization chamber 1 and at least one tubular buffer chamber housing 2. In a preferred embodiment, the RBC includes only these two components. It must be noted, however, that this specific two-component design has been developed to reduce production costs, and the design can also be manufactured as either a single piece or from more than two components. In this embodiment, the tubular depressurization chamber 1 is internally-threaded on its rear section so that it can screw onto external threads provided on a front section of the tubular buffer chamber housing 2. In a preferred embodiment, the tubular buffer chamber housing 2 is also internally threaded so that it can thread onto the muzzle of a firearm 3 providing a removable connection. Once threaded onto the muzzle of a firearm 3, the volume between the end of the muzzle and the interior front face of the tubular buffer chamber housing 2 forms an internally-vented buffer chamber 10. It must also be noted that although this embodiment includes only one internally-vented buffer chamber, it is possible to include multiple internally-vented buffer chambers of this design by threading together in series several tubular buffer chamber housings to provide additional recoil and blast reduction capabilities.

In this embodiment, the interior front face of the tubular buffer chamber housing 2 and the exterior front face of the tubular depressurization chamber 1 have a central bore 5 that is co-axial with the muzzle of the firearm, and through which the bullet passes after leaving the barrel. The tubular buffer chamber housing 2 has at least one smaller buffer chamber opening 4 which allows high-pressure gas to flow from the internally-vented buffer chamber 10 into the tubular depressurization chamber 1. As pictured in FIG. 3, in accordance with one embodiment of the present invention, the smaller buffer chamber openings 4 are round, however the number, shape, size and position of these smaller buffer chamber openings 4 may be adjusted to accommodate different bullet calibers and propellant loads. In a preferred embodiment, there are 2-16 smaller buffer chamber openings 4. In one embodiment of the present invention, the tubular depressurization chamber 1 also has at least one smaller depressurization chamber openings 6 which allow high-pressure gas to flow from the tubular depressurization chamber 1 to the outside atmosphere. In a preferred embodiment, there are 2-16 smaller depressurization chamber openings 6. As pictured in FIG. 3, in this embodiment, the smaller depressurization chamber openings 6 are round, however the number, shape, size and position of these smaller depressurization chamber openings 6 may be adjusted to accommodate different bullet calibers and propellant loads, and to control how the high-pressure gas is released to the outside or reflected rearward toward the interior front face of the tubular buffer chamber housing 2. In addition, in this embodiment, the exterior front face of the front end of the tubular depressurization chamber 1 is shaped so as to reflect the high-pressure gas emitted through the smaller buffer chamber openings 4 rearward towards the muzzle of the firearm 3. In this embodiment, the exterior front face of the tubular depressurization chamber 1 is flat, but it may also have other shapes, including conical or spherical shapes, with either an externally- or internally-curved surface, in order to control how the high-pressure gas is reflected.

In this embodiment, the tubular depressurization chamber 1 also has a series of slotted openings providing vents 7, 8, 9 which allow high-pressure gas to flow from within the tubular depressurization chamber 1 to the outside atmosphere. As pictured in FIGS. 3 and 5, in this embodiment, the assymetrically-arranged vents 7, 8, and 9 have differing widths and lengths, however the number, shape, size and position of these openings may be adjusted to accommodate different bullet calibers and propellant loads, and provide different amounts of resistance to muzzle rise.

In operation, the RBC may be attached to the threaded muzzle of a firearm 3 by screwing an internal threaded section of the tubular buffer chamber housing 2 onto the threaded section of the muzzle. When the firearm 3 is discharged, the bullet is propelled down the bore of the firearm's muzzle and ultimately passes through the internally-vented buffer chamber 10 of the RBC, then into the tubular depressurization chamber 1 and out the end of the RBC. During this passage, the high-pressure gas is captured, channeled and directed in a manner that reduces both recoil and blast effects.

Following discharge of the firearm, the resulting high-pressure propellant gas flows down the barrel of the firearm, pushing the bullet ahead of it. As the bullet passes through the RBC, reduction of the firearm's recoil and muzzle blast is accomplished by four mechanisms. First, as the base of the bullet exits from the muzzle of firearm, the hot, high-pressure propellant gases behind the bullet enter the internally-vented buffer chamber 10. Because of their high pressure, and because the bullet is still occluding most of the central bore 5 of the tubular buffer chamber housing 2, these gases expand into the internally-vented buffer chamber 10 and then vent through internal smaller buffer chamber openings 4 in the interior front face 11 into the tubular depressurization chamber 1. Note that internal smaller buffer chamber openings 4 can be varied in shape and size as required by the firearm caliber and the power of the bullet's propellant powder. Through this gas reaction and internal venting processes, the initial force of the blast and the recoil of the firearm are attenuated.

Second, the force of the blast and the recoil are further attenuated once the vented gas enters the tubular depressurization chamber 1, when a portion of that gas is exhausted to the outside through the smaller depressurization chamber openings 6 and external vents 7, 8, and 9. The shapes, sizes and locations of these external vents are arranged so that they not only externally vent some of gas as described above, but also reflect the remaining portion of the initial gas flow back upon itself thus creating a turbulent mixing of gases in the tubular depressurization chamber 1 and pressure attenuation, a third mechanism serving to further attenuate recoil and blast. The shapes, sizes and locations of the external vents 7, 8, 9 along the length of the tubular depressurization chamber 1 are also influenced by the caliber of the firearm and the power of the bullet's propellant powder.

Finally, as the bullet continues through the central bore 5 of the tubular buffer chamber housing 2, the base of the bullet exits the internally-vented buffer chamber 10, allowing the remaining hot, high pressure propellant gases in the internally-vented buffer chamber 10 behind the bullet to enter the tubular depressurization chamber 1. Upon entering the tubular depressurization chamber 1, the gases not only begin exiting through vents 7, 8, 9, but also encounter gas that was initially vented through smaller buffer chamber openings 4, collided with the exterior front face of the tubular depressurization chamber 1 and was partially reflected back toward the internally-vented buffer chamber 10 while simultaneously venting through smaller depressurization chamber opening 6 and vents 7, 8, 9 thus creating a turbulent mixing zone which further reduces recoil and blast before the gases are completely exhausted to the outside through all the smaller depressurization chamber openings 6 and external vents 7, 8, and 9. The exit of gases from the tubular depressurization chamber 1 through small depressurization chamber openings opening 6 and external vents 7, 8, and 9 as well as the collision and turbulent mixing of the reflected and forward-flowing gases provide the fourth mechanism for attenuating the recoil and muzzle blast.

It must also be noted that it is preferable that there are no external vents 7, 8, or 9 located at either the top or bottom of the tubular depressurization chamber 1 in order to prevent the exhausted gases from pushing the muzzle of the firearm excessively in either the upward or downward direction. The lack of external vents 7, 8, or 9 on the bottom of the tubular depressurization chamber 1 also serves to prevent dust from the ground being blown up when the firearm 3 is fired from a prone position, while the lack of external vents 7, 8, or 9 on the top of the tubular depressurization chamber 1 also serves to prevent the vented hot gases from interfering with the firearm's sights.

It is important to note that the volume of the internally-vented buffer chamber 10 is determined by the caliber of the firearm 3, and by the power of the powder charge used to power the bullet. Additionally, for some calibers and/or more powerful bullets, the use of multiple tubular buffer chamber housings preferably threaded together serially resulting in a plurality of internally-vented buffer chambers 10 may be required. In this example, the RBC a plurality of tubular buffer chamber housings each including a rear section and a front section. The plurality of tubular buffer chamber housings are arranged in series including a muzzle-connectable tubular buffer chamber housing, a depressurization chamber-connectable tubular buffer chamber housing, and optionally at least one intermediary tubular buffer chamber housings disposed therebetween. In one embodiment, when only two tubular buffer chamber housings are used, no intermediary tubular buffer chamber housings are included. The muzzle-connectable tubular buffer chamber housing has a rear section that is removably connectable to the muzzle of a firearm and a front section that is connectable to a rear section of said intermediary tubular buffer chamber housing or a rear section of the depressurization chamber-connectable tubular buffer chamber housing. The depressurization chamber-connectable tubular buffer chamber housing has a front section that is connectable to a tubular depressurization chamber and a rear section that is connectable to a front section of the intermediary tubular buffer chamber housing or the front section of the muzzle-connected tubular buffer chamber housing. The plurality of tubular buffer chamber housings and the tubular depressurization chamber are arranged such that a central bore extends through each of the plurality of tubular buffer chamber housings and the tubular depressurization chamber and is co-axial with the muzzle. Each of the tubular buffer chamber housings includes an internally-vented buffer chamber and an interior front face. The interior front face is disposed within a rear section of the intermediary tubular buffer chamber housing or within said tubular depressurization chamber. The tubular depressurization chamber has a rear portion connectable to the front section of the depressurization chamber-connectable tubular buffer chamber housing, a tubular wall, and an exterior front face. The tubular wall of the tubular depressurization chamber has a plurality of vents. The exterior front face has a central opening that is co-axial with the muzzle and includes at least one depressurization chamber opening. In one embodiment, each of the tubular buffer chamber housings are removably connectable to each other and the depressurization chamber-connectable tubular buffer housing is removably connectable to the tubular depressurization chamber. Furthermore, in a preferred embodiment, the front section of each of the tubular buffer chamber housings is externally threaded and the rear section of each of the tubular buffer chamber housings is internally threaded. Since the use of multiple internally-vented buffer chambers 10 increases the overall length of the RBC, the total amount of recoil and muzzle blast reduction desired must be considered with regard to the desired overall length of the RBC.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth if the appended claims and any and all equivalents thereof.

What is claimed is:

1. A recoil and blast controller for attachment to the muzzle of a firearm comprising:

a tubular buffer chamber housing including a rear section and a front section wherein said rear section is removably connectable to the muzzle of a firearm and said front section is connectable to a tubular depressurization chamber such that a central bore extends through said tubular buffer chamber housing and said tubular depressurization chamber and is co-axial with the muzzle;

said tubular buffer chamber housing includes an internally-vented buffer chamber provided between the muzzle and an interior front face of said tubular buffer chamber housing, said interior front face is disposed within said tubular depressurization chamber and has a central opening that is co-axial with the muzzle and includes at least one smaller buffer chamber opening; and said tubular depressurization chamber has a rear portion, a tubular wall, and an exterior front face; said rear portion is connectable to the front section of said tubular buffer chamber housing, said tubular wall has a plurality of vents; and said exterior front face has a central opening that is co-axial with the muzzle and includes at least one smaller depressurization chamber opening.

2. The recoil and blast controller of claim 1 wherein said tubular depressurization chamber is removably connectable to said tubular buffer chamber housing.

3. The recoil and blast controller of claim 2 wherein said front section of said tubular buffer chamber housing is externally threaded and said rear portion of said tubular depressurization chamber is internally threaded.

4. The recoil and blast controller of claim 1 wherein said smaller buffer chamber openings and said smaller depressurization chamber opening are round.

5. The recoil and blast controller of claim 4 wherein said tubular buffer chamber housing includes 2-16 smaller buffer chamber openings.

6. The recoil and blast controller of claim 4 wherein said tubular depressurization chamber includes 2-16 smaller depressurization chamber openings.

7. The recoil and blast controller of claim 1 wherein said central opening in said interior front face and said central opening in said exterior front face are circular.

8. The recoil and blast controller of claim 1 wherein said exterior front face is flat.

9. The recoil and blast controller of claim 1 wherein said exterior front face is conical or spherical with either an externally or internally curved surface.

10. The recoil and blast controller of claim 1 wherein said plurality of vents are arranged on said tubular wall such that no vents are provided on a top or bottom section of the tubular wall.

11. A recoil and blast controller for attachment to the muzzle of a firearm comprising:

a plurality of tubular buffer chamber housings each including a rear section and a front section, said plurality of tubular buffer chamber housings are arranged in series including a muzzle-connectable tubular buffer chamber housing, a depressurization chamber-connectable tubular buffer chamber housing, and optionally at least one intermediary tubular buffer chamber housings disposed therebetween, wherein said muzzle-connectable tubular buffer chamber housing has a rear section that is removably connectable to the muzzle of a firearm and a front section that is connectable to said rear section of said intermediary tubular buffer chamber housing or said rear section of said depressurization chamber-connectable tubular buffer chamber housing, said depressurization chamber-connectable tubular buffer chamber housing has a front section that is connectable to a tubular depressurization chamber and a rear section that is connectable to said front section of said intermediary tubular buffer chamber housing or said front section of said muzzle-connected tubular buffer chamber housing, said plurality of tubular buffer chamber housings and said tubular depressurization chamber are arranged such that a central bore extends through each of said plurality of tubular buffer chamber housings and said tubular depressurization chamber and is co-axial with the muzzle;

each of said tubular buffer chamber housings includes an internally-vented buffer chamber and an interior front face, wherein said interior front faces is disposed within a rear section of said intermediary tubular buffer chamber housing or within said tubular depressurization chamber, and said tubular depressurization chamber has a rear portion, a tubular wall, and an exterior front face; said rear portion is connectable to the front section of said depressurization chamber-connectable tubular buffer chamber housing, said tubular wall has a plurality of vents; and said exterior front face has a central opening that is co-axial with the muzzle and includes at least one depressurization chamber opening.

12. The recoil and blast controller of claim 11 wherein said a plurality of tubular buffer chamber housings are removably connectable to each other and said depressurization chamber-connectable tubular buffer chamber housing is removably connectable to said tubular depressurization chamber.

13. The recoil and blast controller of claim 12 wherein said front section of each of said tubular buffer chamber housings is externally threaded and said rear section of each of said tubular buffer chamber housings is internally threaded and said rear portion of said tubular depressurization chamber is internally threaded.

14. The recoil and blast controller of claim 11 wherein said smaller buffer chamber openings and said smaller depressurization chamber opening are round.

15. The recoil and blast controller of claim 11 wherein each of said buffer chamber housings includes 2-16 smaller buffer chamber openings.

16. The recoil and blast controller of claim 11 wherein said depressurization chamber includes 2-16 smaller depressurization chamber openings.

17. The recoil and blast controller of claim 11 wherein said central opening in each of said interior front faces and said central opening in said exterior front face are circular.

18. The recoil and blast controller of claim 11 wherein said exterior front face is flat.

19. The recoil and blast controller of claim 11 wherein said exterior front face is conical or spherical, with either an externally or internally curved surface.

20. The recoil and blast controller of claim 11 wherein said plurality of vents are arranged on said tubular wall such that no vents are provided on a top or bottom section of the tubular wall.

* * * * *